United States Patent [19]

Suwabe

[11] 4,444,274

[45] Apr. 24, 1984

[54] LIQUID PRESSURE STRIKING DEVICE

[75] Inventor: Isaku Suwabe, Mishima, Japan

[73] Assignee: Maruzen Kogyo Company Limited, Mishima, Japan

[21] Appl. No.: 294,173

[22] Filed: Aug. 19, 1981

[30] Foreign Application Priority Data

Aug. 29, 1980 [JP] Japan ..... 55-118288
Sep. 19, 1980 [JP] Japan ..... 55-133238[U]

[51] Int. Cl.[3] ..... F01B 7/18; F01L 25/06

[52] U.S. Cl. ..... 173/134; 91/231; 91/319; 91/321; 91/452; 92/134

[58] Field of Search ..... 91/319, 305, 306, 309, 91/313, 231, 321; 173/134

[56] References Cited

U.S. PATENT DOCUMENTS

| | | | |
|---|---|---|---|
| 3,035,548 | 5/1962 | Wittlich | 91/319 |
| 3,963,383 | 6/1976 | Hill | 91/313 |
| 4,028,995 | 6/1977 | Salmi et al. | 91/319 |
| 4,084,486 | 4/1978 | Juvonen | 91/319 |
| 4,165,788 | 8/1979 | Montabert | 91/319 |

*Primary Examiner*—Paul E. Maslousky

*Attorney, Agent, or Firm*—Michael J. Striker

[57] ABSTRACT

A liquid pressure striking device defines a double-acting cylinder in a main body thereof having a tool at its lowest portion, and the double-acting cylinder houses therewithin a piston having an upper rod and a lower rod. The lower rod suspends a hammer for striking the tool, and the upper rod is provided on its outer circumference with a change-over valve mechanism which comprises a valve body of special structure for automatically switching the liquid flow under pressure by vertical movement of the piston, and a valve chamber having a plurality of concaves for controlling said valve body. Above the upper part of the valve chamber, there is provided an accumulator serving as a cap or cover of the main body. The main body is formed with an inlet passage of the liquid and an outlet passage, communicating with the accumulator and the valve chamber. Between the inlet and outlet passages, a special return springless actuating valve intervenes which is furnished with a circuit for directing the liquid to the outlet from the inlet without introducing it into the main body of the device, when the main body is not actuated.

7 Claims, 17 Drawing Figures

4
12
13
26b
91
A
A
A
6
15
91a
92
B
B
20
14
93
96
94
B
26a
27
31
18
B
51
B
7
A
52
8

LIQUID PRESSURE STRIKING DEVICE

BACKGROUND OF THE INVENTION

The invention relates to a liquid pressure striking device to be used for destroying rocks, stones, roads, buildings and others.

BRIEF EXPLANATION OF THE PRIOR ART

In general, a compression air striking apparatus has been used for destroying rocks, roads, buildings and others. However this kind of the apparatus causes large explosion sound in the towns, and instead a liquid pressure apparatus of low striking sound has been recently employed.

The apparatus of the liquid pressure as power source slidably disposes a piston within a cylinder housed in a main body thereof. The liquid pressure recipricates the piston and strikes a tool as a chisel or the like by means of the piston itself or a hammer provided to a lower end of a rod connected to the piston. In this kind of the apparatus, important elements are a change-over mechanism for giving reciprocation to the piston by automatically switching flow of the pressure liquid and a mechanism for controlling said mechanism. Conventionally, the mechanism is complicated in the structure, and if it were incorporated into the apparatus, the main body became extremely bulky, and if it were instead arranged outside of the main body for a control unit, the apparatus inevitably became large scaled and could not prevent inconvenience in handling. Further, when the piston goes down (striking process) pulsation is caused in a hose due to absorbing the actuating liquid in a low pressure line, and makes large movement in the hose. For controlling the pulsation it is necessary to prepare an accumulator which is solely used for absorbing the pulsation, independently of the pressure accumulator, and the former is largely present by the main body, so that the apparatus is as a whole large scaled to cause inconvenience in handing. In addition, the inlet port of the actuating liquid and the outlet port with respect to the cylinder are remote each other. Since the liquid is exhausted through a piston actuating circuit in stopping period of the apparatus, resistance by the running liquid is large during returning to the storage, so that loss in actuation is disadvantageously large.

It may be considered that the piston and the liquid flow change-over mechanism are coaxially arranged for measure to improve said large diameter of the apparatus. However, if such an arrangement were merely reduced to practice and in case the liquid leaked through slight space between the valve body as the main body of the change-over mechanism and the valve chamber coaxially housing said valve body, the valve body would unreadily move in the valve chamber and this occasion would cause errorneous action in controlling the flow of the pressure liquid. Thus the conventional apparatus has not been practicable.

OBJECTS OF THE INVENTION

The present invention has been devised through many studies and investigations in view of the above mentioned circumstances.

A basic object of the invention is to produce a liquid pressure striking device where the structured are simple in a mechanism for automatically switching the pressure liquid flow for giving reciprocation to the piston and a mechanism for controlling said mechanism and a mechanism for preventing absorption of the actuating liquid in the lower pressure line when the piston goes down so that the device is slim as a whole, and is easy in production and convenient in handling.

Another object of the invention is to produce a liquid pressure striking device which does not need a pulsation absorbing accumulator, and in which a pressure accumulator serves as a removable cap or cover on a top of the main body, thereby to easily enable to easily observe the interior of the apparatus and exchange parts, and rapidly carrying out exchanging with another accumulator at disordering or filling the gas.

A further object of the invention is to produce a liquid pressure striking device in which the inlet port of the actuating liquid and the outlet port are very nearly positioned, and when the apparatus is not operated the actuating liquid is directed to the outlet port from the inlet port instead of passing through the circuit in the main body, so that loss in actuation is checked to the minimum and automatic recovery of the actuating valve may be provided without requiring a return spring.

A still further object of the invention is to produce a liquid pressure striking device in which the liquid is alternately is flown under pressure into an upper chamber of the piston and a lower chamber, and the valve body for causing the striking action is stably maintained at a determined position in the valve chamber during the vertical movement of the piston except switching of the liquid flow so that no errorneous action is given to the operation.

SUMMARY OF THE INVENTION

For accomplishing the above mentioned object, this invention adopts under mentioned basic structures in the liquid pressure striking device. The device defines a double-acting cylinder in a main body thereof having a tool at its lowest portion, and the double-acting cylinder houses therewithin a piston continuing to a lower piston which suspends a hammer for striking the tool by reciprocation of the piston. The piston is provided with an upper piston (control piston) whose diameter is smaller than those of said piston and said lower piston. On the upper piston there coaxially surrounds a valve body which alternately switches the flow of the liquid to automatically flow it into the upper piston chamber and the lower pistom chamber and there is defined, coaxially with the valve body, a valve chamber for controlling action of the valve body together with reciprocation of the piston.

On the other hand, the main body is formed at its upper portion with an inlet passage and an outlet passage in parallel which communicate each other via an actuating valve. At a top portion of the main body as an end of the inlet passage, an upper chamber is formed which communicates with a lower piston chamber via a passage, and is detachably mounted with an accumulator.

The valve chamber is, in descending order, formed with first, second and third concaves with spaces. The first concave normally interrupts communication between the upper chamber and the valve chamber in corporation with a ring like head portion of the valve body, and makes communication between the upper chamber and the upper piston chamber via the passage only when the piston goes down. The second and third concaves make mutual communication when the piston goes up, thereby to flow the actuating liquid from the upper piston chamber to the outlet passage, and when the piston goes down the mutual communication is blocked by means of the upper flange of the valve body, thereby to interrupt the passage between the upper piston chamber and the outlet passage.

Between the valve chamber and the upper piston chamber there is provided a concave which makes communication between the valve chamber and the outlet passage only when the piston is switched, and which discharges the pressure of maintaining the switching valve.

The structures are simple in the mechanism for automatically switching the pressure liquid flow for giving reciprocation to the piston and the mechanism for controlling the former mechanism. Further the present device does not need the accumulator which is solely used for preventing the absorption of the pulsation of the liquid into the low pressure line when the piston goes down nor the returning spring for the actuating valve. Therefore, the device is as a whole slim.

Further, being excellent in the preventing effect of the pulsation, the main body is not vibrated. The inlet port and the outlet port are nearly positioned so that the hose is regulated in order. When the apparatus is at rest, the actuating liquid is directly exhausted from the inlet to the outlet, not passing through the route in the main body, thereby to check the loss of force to the minimum. The accumulator also serves as the cap of the main body and is detachable for easily carrying out the observation of the interior, exchange of the accumulator and attachment of the switching valve.

DETAILED DESCRIPTION OF THE INVENTION

FIGS. 1 to 10 show one embodiment of a liquid pressure striking device according to the invention, in which the numeral 1 is a main body of the device having a tubular portion 1*a* at a lower part thereof. The device is provided with a tool 2 such as chisel to the tubular portion 1*a*, operating handles 3, 3 at the top portion of the main body, and an accumulator 4 on the top portion.

Figure 5:
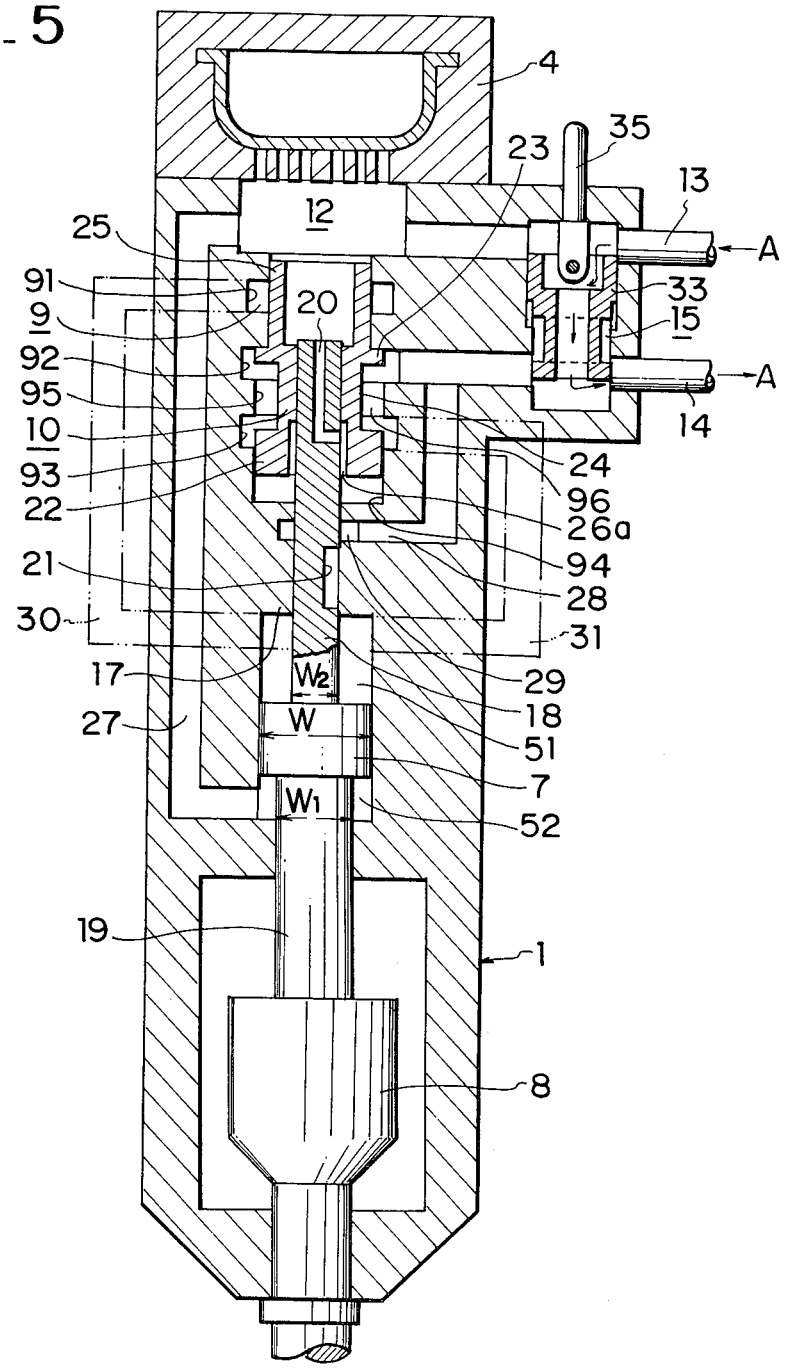
FIGS. 5 to 10 are cross sectional views stepwise showing use conditions of the present device.

The numeral 5 is a double-acting cylinder which is vertically defined on a bottom 61 of the main body 1, and has a slidable piston 7 therein. The piston 7 is provided on its lower end with a lower piston, i.e., a striking piston 19 coaxially with said tool 2. The lower piston 19 extends into the tubular body 1*a* and fixes a hammer 8 at its end portion. Further, the piston 7 is provided on its upper end with a bar like upper piston, i.e., a control piston 18 coaxially with said lower piston 19. The piston 7, the lower piston 19 and the upper piston 18 are in such relationship $W<W1<W2$ in diameter as shown in FIG. 5. Within the double-acting cylinder there are formed an upper piston chamber 51 and a lower piston chamber 52 at a center as the piston 7.

The numeral 6 designates a change-over valve mechanism constituting one of the characteristics of the invention, which is composed of a valve chamber 9 defined on the double-acting cylinder 5 via a partition 17 and a valve body 10 housed in the valve chamber 9. The upper piston 18 passes centrally of the valve chamber 9 through the partition 17, and the valve body 10 is mounted on the upper piston 18 in relatively slidable relation. The valve body 10 is moved upwardly or downwardly by inlet or outlet of the liquid into or from the valve chamber 9 in accompany with vertical movement of the upper piston 18, whereby the liquid is alternately flown into the upper piston chamber 51 or the lower piston chamber 52, and gives reciprocation to the piston 7.

The numeral 11 denotes an oblique projection following a lower side of the top portion of the main body 1, and the oblique projection 11 is provided with an inlet passage 13 communicating with an upper chamber 12 which is defined between an accumulator 4 and the valve chamber 9, as well as provided with an outlet passage 14 nearly to and in parallel to the inlet passage 13. The inlet passage 13 and the outlet passage 14 cross with an actuating valve 15. These both passages 13 and 14 are connected or disconnected by means of an operating lever 16, so that the actuating liquid is flown into the main body and exhausted through the outlet passage 14.

Figure 3:
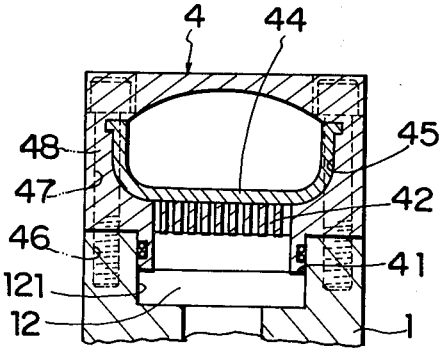
FIG. 3 is a cross sectional view showing a structure of a top portion of the invention.

The upper chamber 12 opens at the top portion of the main body 1. The accumulator 4 has, as shown in FIG. 3, a ring projection 41 fitting on an inner diameter face 121 of the upper chamber 12. The ring projection 41 is formed in an inner side thereof with a plurality of perforations 42 for the upper chamber 12, and there is provided, at an inner part of the perforations 42, a liquid storage 45 expanding a diaphragm 44. The accumulator 4 is formed at its corners with vertical holes 47 corresponding to female screws 46 formed in the main body 1, and bolts 48 are screwed thereinto so that the accumulator 4 is detachably mounted on the main body 1.

The upper piston 18, the valve 9 and the valve body 10 are coaxially arranged respectively. The upper piston 18 is, as shown in FIG. 5, defined with a spool duct whose one end opens upwardly and the other end opens towards the side wall, and is defined, at a lower position than the duct, with a duct 21 in concave which normally opens towards the partition 17. The duct 21 serves to discharge the liquid pressure in a lower space of a later mentioned valve chamber into the outlet passage 14 when switching to "up" or "down" of the piston 7.

The valve chamber 9 has at its bottom a lower space 94 of a tubular valve chamber for housing the lower flange 22 of the valve body 10, and is formed with concaves 91, 92, 93 in ring.

The valve body 10 has a lower flange 22 to be housed in the lower space 94 of the valve chamber 9 and an upper flange 23 in opposition to the lower flange 22 at determined space. The upper flange 23 is made coaxially with the lower flange 22 in the outer diameter. When the piston goes up, the upper flange 23 contacts the ceiling of the second concave 92, and when the piston goes down the flange 23 contacts a projection 95 between the second concave 92 and the third concave 93 and interrupts said both concaves. Between the lower flange 22 and the upper flange 23, a portion 24 is formed for communicating the second concave 92 and the third concave 93 to provide a passage. The flange 23 is followed by a circular head 25 for interrupting the communication between the first concave 91 and the upper chamber 12 at the normal time and when the piston goes up and for making the communication of the concave 91 between the upper chamber 12 and the upper piston chamber 51 only when the piston goes down. The valve body 10 is defined with a ring hole **26*a* of determined depth in order to communicate with a spool duct 20 of the upper piston 18. In this embodiment, the ring hole 26*a*** does not open toward the outer wall of the valve body.

The valve chamber 9 is defined with a passage 27 to make communication between an upper chamber 12 and a lower piston chamber 52. The outer passage 14 communicates with the second concave 92 and is branched with an exhausting passage 28 at its central portion. The exhausting passage 28 is connected to a concave 29 which is formed coaxially with an upper piston 18 between a space 94 at a lower part of the valve chamber and the partition 17. The concave 29 communicates with the duct 21 of the upper piston 18 only when the piston is switched upwardly for introducing the actuating liquid supposed in the space 94 into the exhausting passage 28.

The main body is further defined with a passage 30 to make communication between the first concave 91 and the upper piston chamber 51 as well as a passage 31 to make communication between the third concave 93 and the upper piston chamber 51.

The first concave 91 communicates with the upper piston chamber 51 through the passage 30, and normally interrupts the communication between the upper chamber 12 and the valve chamber 9 in corporation with the tubular head 25 of the valve body 10, and make communication between the upper chamber 12 and the upper piston chamber 51 through the passage 30 only when the piston goes down.

On the other hand, the second concave 92 communicates with a rear end of the outlet passage 14 and the third concave 93 communicates with the upper piston chamber 51 through the passage 31. When the piston goes up, the communication is made between the second concave 92 and the third concave 93 to flow the actuating liquid into the outlet passage 14 from the upper piston chamber 51, and when the piston goes down the communication is broken by the upper flange 23 of the valve body 10 to block the passage 31 connecting the upper piston chamber 51 and the outlet passage 14.

Figure 1:
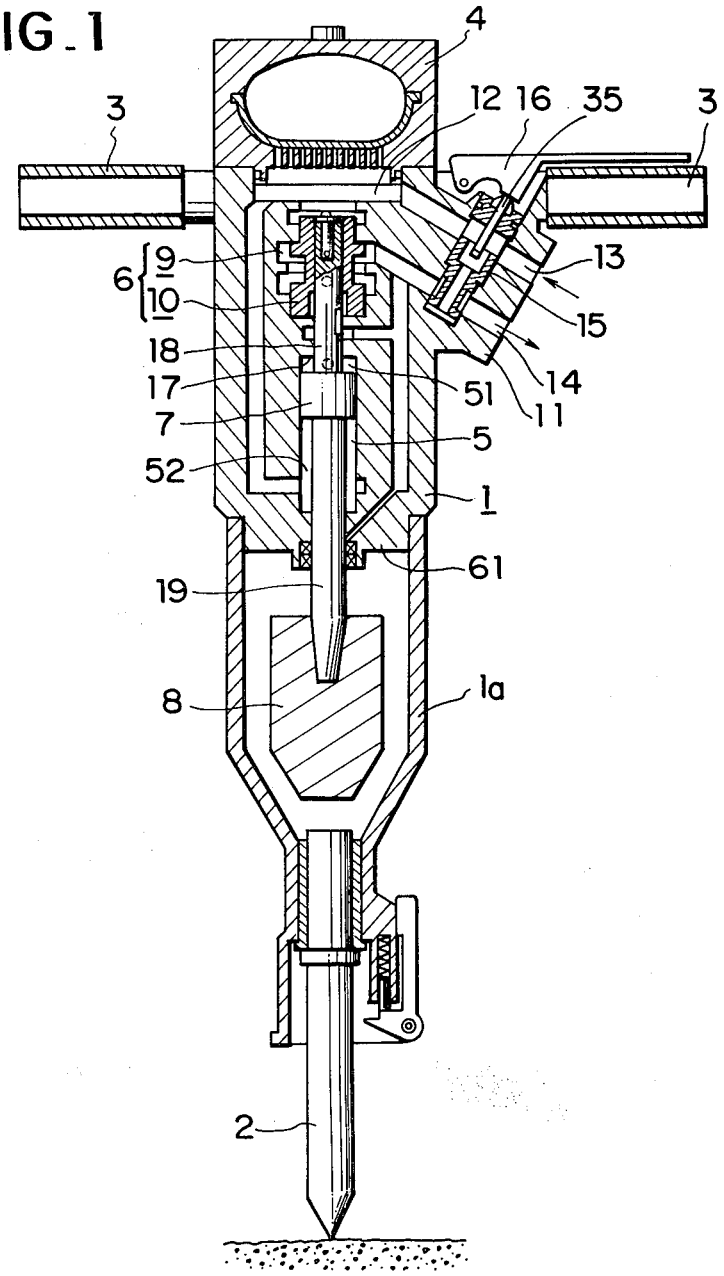
FIG. 1 is a cross sectional view showing one embodiment of a liquid pressure striking device according to the invention.
Figure 2A:
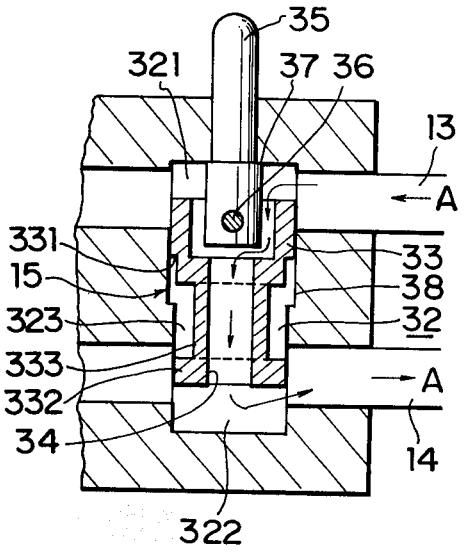
FIG. 2(A) and FIG. 2(B) are cross sectional views showing a structure of an actuating valve and actuation thereof in the invention.
Figure 2B:
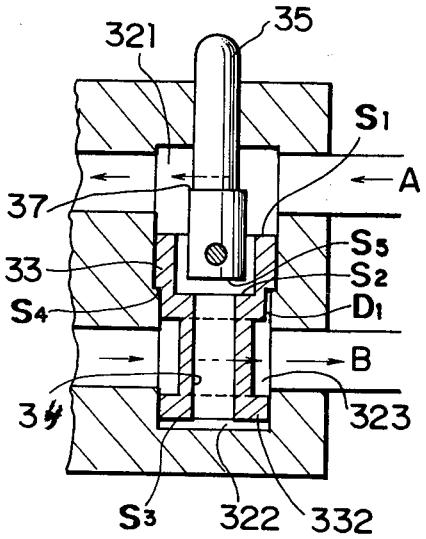
Figure 4:
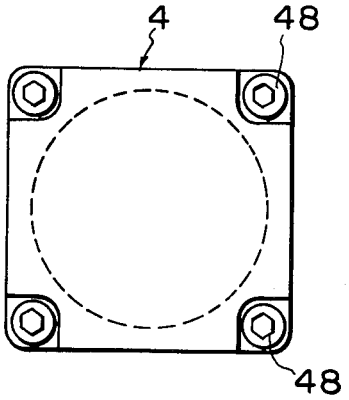
FIG. 4 is a plan view of the same.

FIGS. 1, 2(A) and 2(B) show in detail the actuating valve 15 as one of the characteristics of the invention. The actuating valve 15 has the valve chamber 12 which traverses the inlet 13 and the outlet 14 in parallel, and the sleeve like valve body 33 which is slidably housed in the valve chamber 32 and passes a vertical passage 34, and the actuating rod 35 which is connected at its lower end in the passage of the valve body 33 by a pin 36 and has a step 37 at its center and projects through an oblique wall at its upper portion than the step 37.

The valve chamber 32 connects in series a valve upper chamber 321 crossing with the inlet passage 13 and a valve lower chamber 322 crossing with the outlet passage 14 and being partially lower than the outlet passage 14. A step 38 surrounds between the chambers 321 and 322.

The valve body 33 has a stopper 331 contacting the step 38 or the outer diameter and a flange 332 contacting the inner wall of the valve lower chamber 322 at its bottom, and is formed with a diameter reducing portion 333.

FIGS. 11 to 16 show the other embodiment of the invention in which the aforementioned change-over mechanism 6 is more improved and even if a small leaking clearance were made, the lower space of the valve chamber may be maintained at the determined pressure. The finishing precision on the sliding surfaces of the valve chamber 9, the valve body 10 and the upper piston 18 may be made to the moderate extent, thereby to simplify the production of the apparatus.

On the valve body 10, a duct 26 is formed which always communicates at its one end with a lower space 94 of the valve chamber and communicates at its other end with the outer diameter portion of the valve body. In the valve chamber 9, a ring like central concave **91*a* is formed between a first concave 91 and a second concave 92. The central concave 91*a* communicates via a passage 97 with a passage 27 connecting the upper chamber 12 and the lower piston chamber 52. The duct 26 is, in this embodiment, composed of the ring like hole 26*a* and a narrow path 26*b* running in obliquity from the hole 26*a* to the outer diameter portion. The narrow passage 26*b* communicates with the central concave 91*a* when the valve body 10 is positioned upwardly, and it communicates with the second concave 92 when the valve body 10 is positioned downwardly. Depending upon the height of the valve body 10, the ring like hole 26*a* may be omitted and the narrow passage 26*b* may be of course extended up to the valve body from the outer diameter portion, and such an embodiment should be included within the scope of the invention. When the valve body 10 is positioned upwardly, the duct 26 supplies the liquid under high pressure to the lower space 94 through the passage 27 and the central concave 91*a*. When the valve body 10 is positioned downwardly, the duct 26 discharges the leaking liquid under high pressure into the outlet passage 14 via the second concave 92 from the lower space 94**.

A reference will be made to actuation of the liquid pressure striking device. If the actuating rod 35 is not pushed down by the operating lever 16, the actuating liquid under high pressure curves at the central part of the actuating rod 35, and directly returns to a not shown tank from the outlet passage 14 through the passage 34 of the valve body 33. Therefore, when the apparatus is not actuated, the liquid returns without accompanying resistance so that the loss of the power could be controlled to the minimum.

In the above condition, the valve chambers 321, 322 and 323 are all communicated, the backpressure only is low in each of the valve chambers, thereby to countervail the pressure acting on upper areas S1, S2 of the valve body 33 and the pressure to a lower area S3 and an area S4 of the stopper portion, so that the actuating rod 35 is pushed upwardly than the valve body 33 by the low pressure acting on a lower area S5 of the actuating rod, and the step 37 thereof serves as a stopper and is maintained there. Subsequently, the actuating rod 35 is worked and the valve body 31 is moved down by the operating lever 16 until the stopper portion 331 engages the step 38, so that the passage between the inlet 13 and the outlet 14 is blocked by the flange 332 of the valve body 33 (refer to FIG. 2(B), and the high pressure actuating liquid from the inlet turns out a flood A to flow into the main body of the apparatus, and it turns out a flood B to flow out of the outlet 14 via the outside of the diameter reducing portion.

Figure 6:
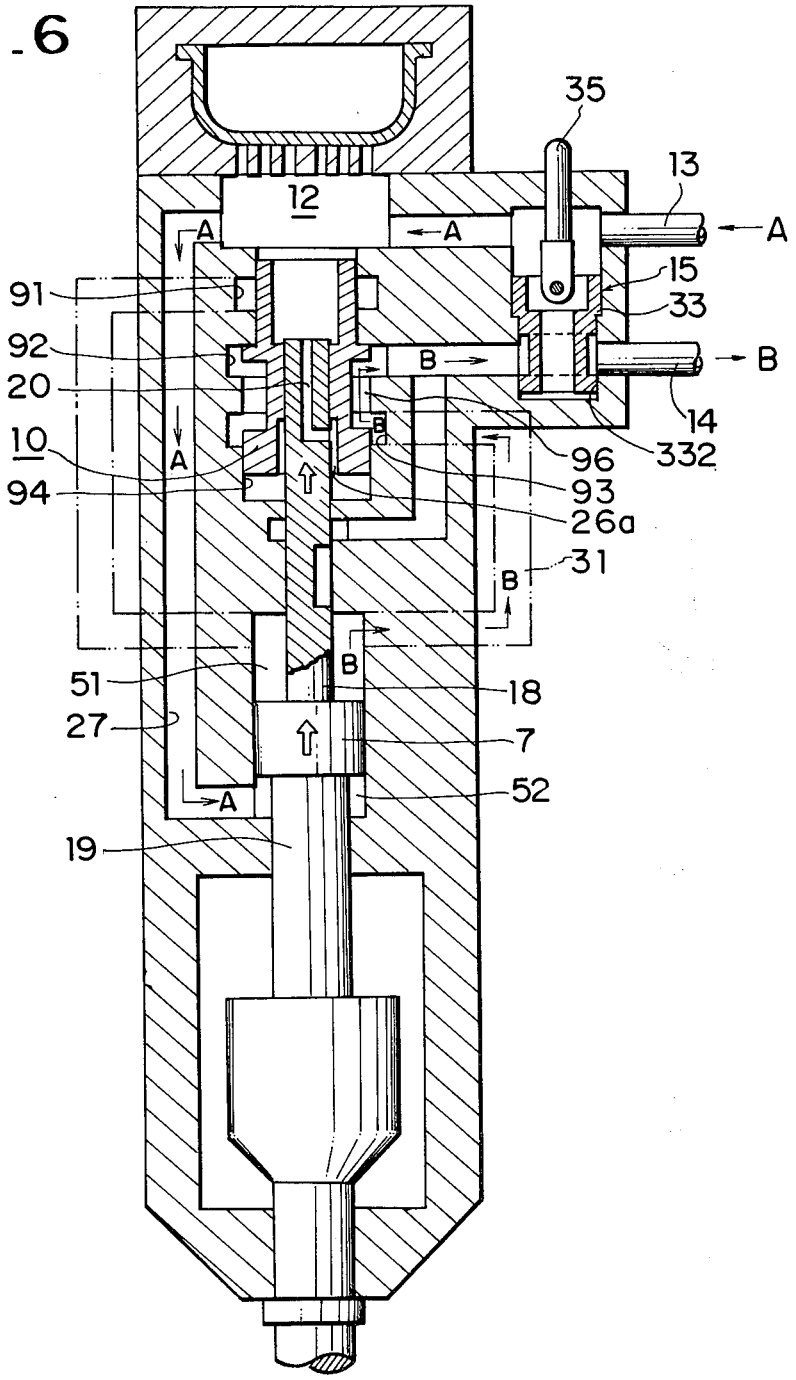

That is, as shown in FIG. 6, the high pressure actuating liquid passes through the upper chamber 12 and the passage 27 and is introduced into the lower piston chamber 52, and it urges up the piston 7 and the hammer 8 by force created by difference in area of the lower piston chamber 52 and the upper piston 18. Concurrently, it moves up the piston 18 positioned on the piston 7. At this time, the actuating liquid within the upper piston chamber 51 passes as a flood B through the passage 31 and a relay 96 composed of the second and third concaves 92, 93, and gets out of the outlet 14. The high pressure liquid passes through the spool duct 20 and the ring hole 26 of the switching valve 10 and goes into the valve chamber 94 to provide the same pressure as in the upper chamber 12. Since the lower area of the valve body 10 is larger than the upper area, the valve body 10 is maintained at the upper position as shown by the force created by the difference in area.

Figure 7:
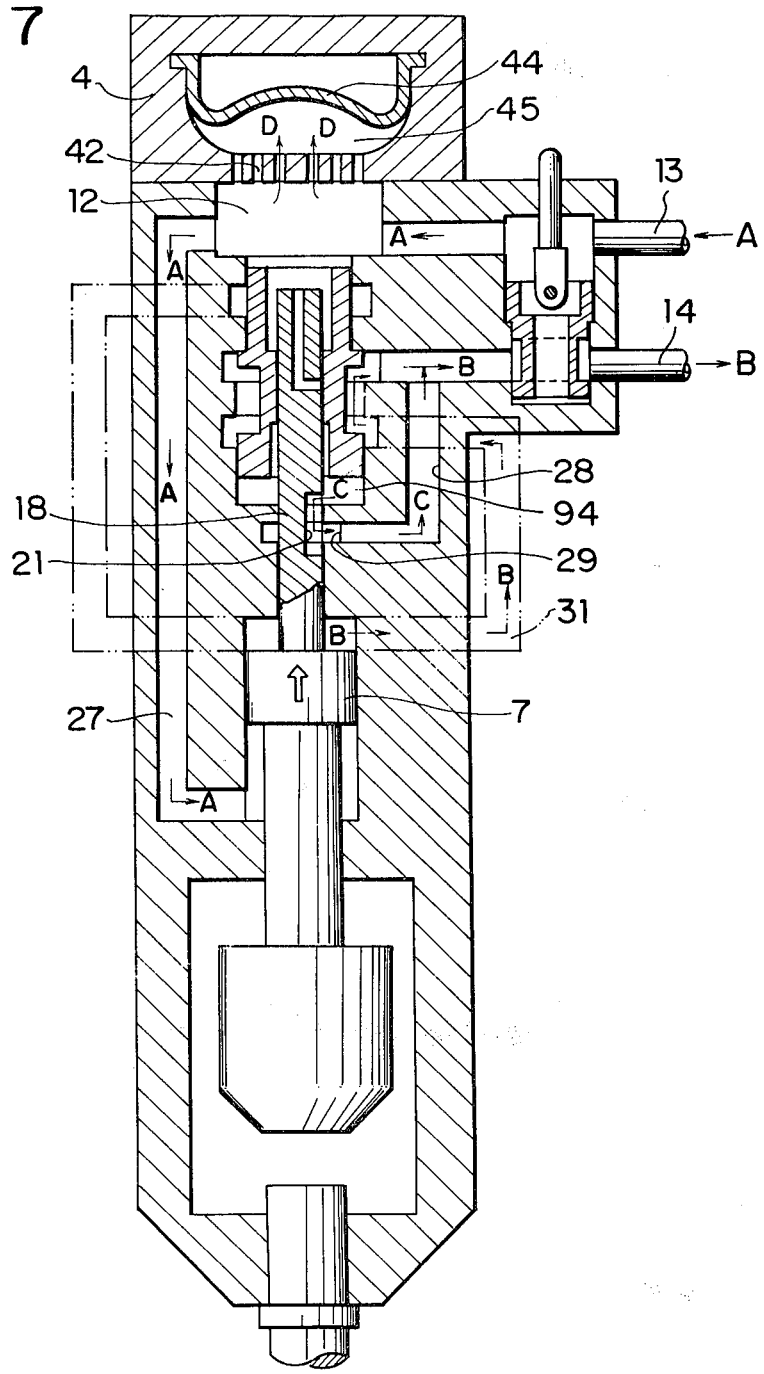

The high pressure actuating liquid from the inlet passage 13 moves up the piston 7 as shown in FIG. 7, and at the same time it passes the passage 42 from the upper chamber 12 and advances as a flood D into the accumulator and moves up the the diaphragm 44 while compressing the sealing gas (such as N gas), and is accumulated in the storage 45.

The upper piston 18 is moved up together with the piston 7, and when the duct 21 moves up until it makes the communication of the lower space 94 and the concave 29, the high pressure liquid maintaining the valve body 10 at the upper limit gets as the flood C out of the outlet 14 through the duct 21 and an exhausting passage 28 from the lower space 94. Thereby the valve body 10 is made free, and it is moved down along the upper pisition 18 by action of the high pressure of the upper chamber 2, and the valve body is stabilized at the lower position, that is, where the lower flange 22 contacts the bottom of the lower space 94, and the upper flange 23 contacts a projecting circumference of the valve chamber 9.

Figure 8:
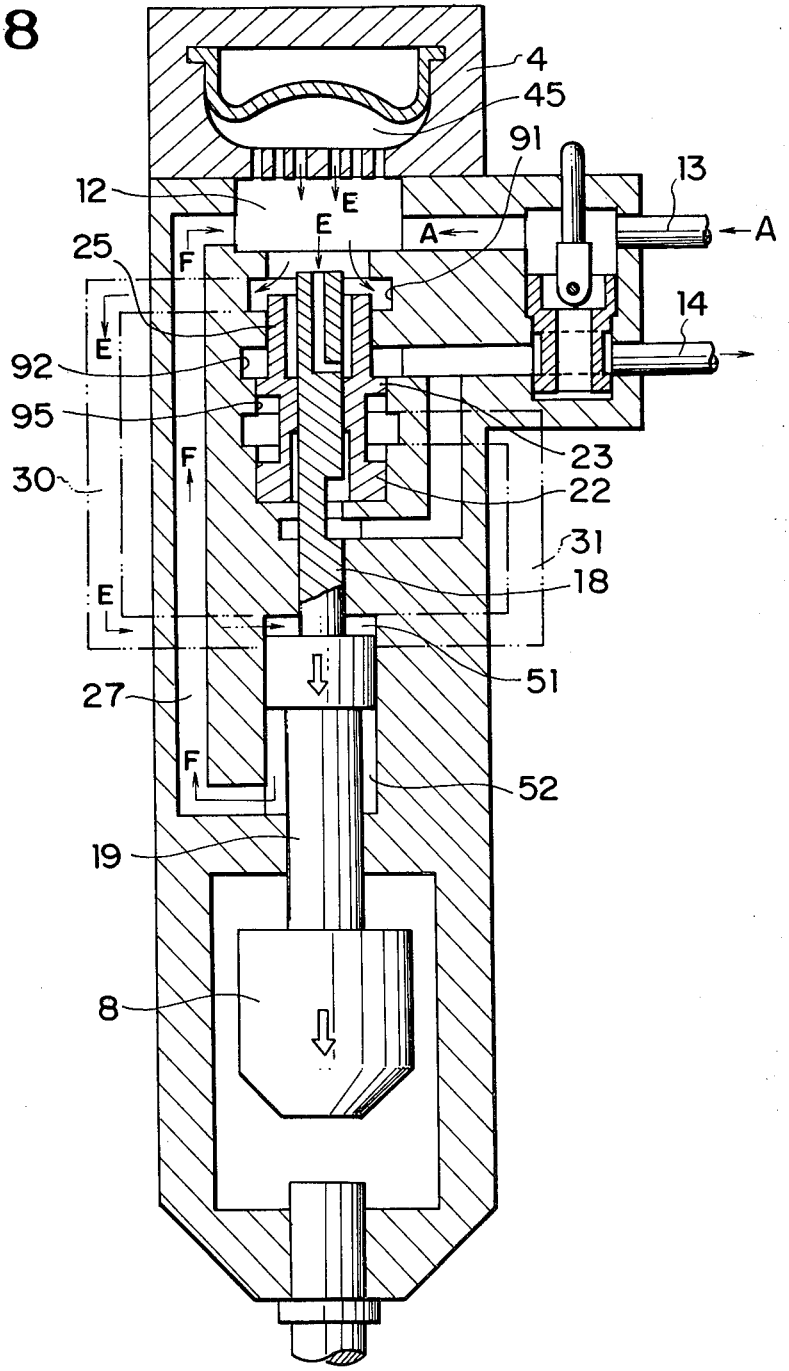

FIG. 8 shows the descending process of the piston. When the valve body 10 reaches the lower limit, the upper flange 23 blocks between the second concave 92 and the third concave 93, and at the same time the communication is made between the upper chamber 13 and the first concave 91 by the ring head moving down. The high pressure liquid turns out the flood E and flows into the upper piston chamber 51 via the first concave 91 and the passage 30 from the upper chamber 12. The area of the upper piston chamber 51 is far larger than that of the lower piston chamber 52. Therefore, the lower piston 19 is rapidly urged down by the force corresponding to the difference in area. Then, the liquid stored in the accumulator 4 is discharged as the flood E and passes through the upper chamber 12 to accelerate the upper piston 18. The liquid in the piston lower chamber 52 is got out and passes the way 27 and counterflows as a flood F into the upper chamber 12 to push up the upper piston 18.

As is seen, the upper piston 18 is accelerated together with the lower piston 19. By resultant force of such pressure to the upper and lower areas, the hammer 8 is rapidly accelerated in the descending direction. Then, the passage 31 combining the upper piston chamber 51 and the third concave 93 is closed by the upper flange 23 and the lower flange 22, and the outlet passage 14 is interrupted from the both of the upper piston chamber 51 and the lower piston chamber 52. Therefore, the absorption of the liquid from the outlet port 14 never occurs while the piston 7 goes down, thereby to reduce the pulsation of the liquid, so that a pulsation absorbing accumulator is not required, and the hose life can be elongated since fluttering of the hose is little.

Figure 9:
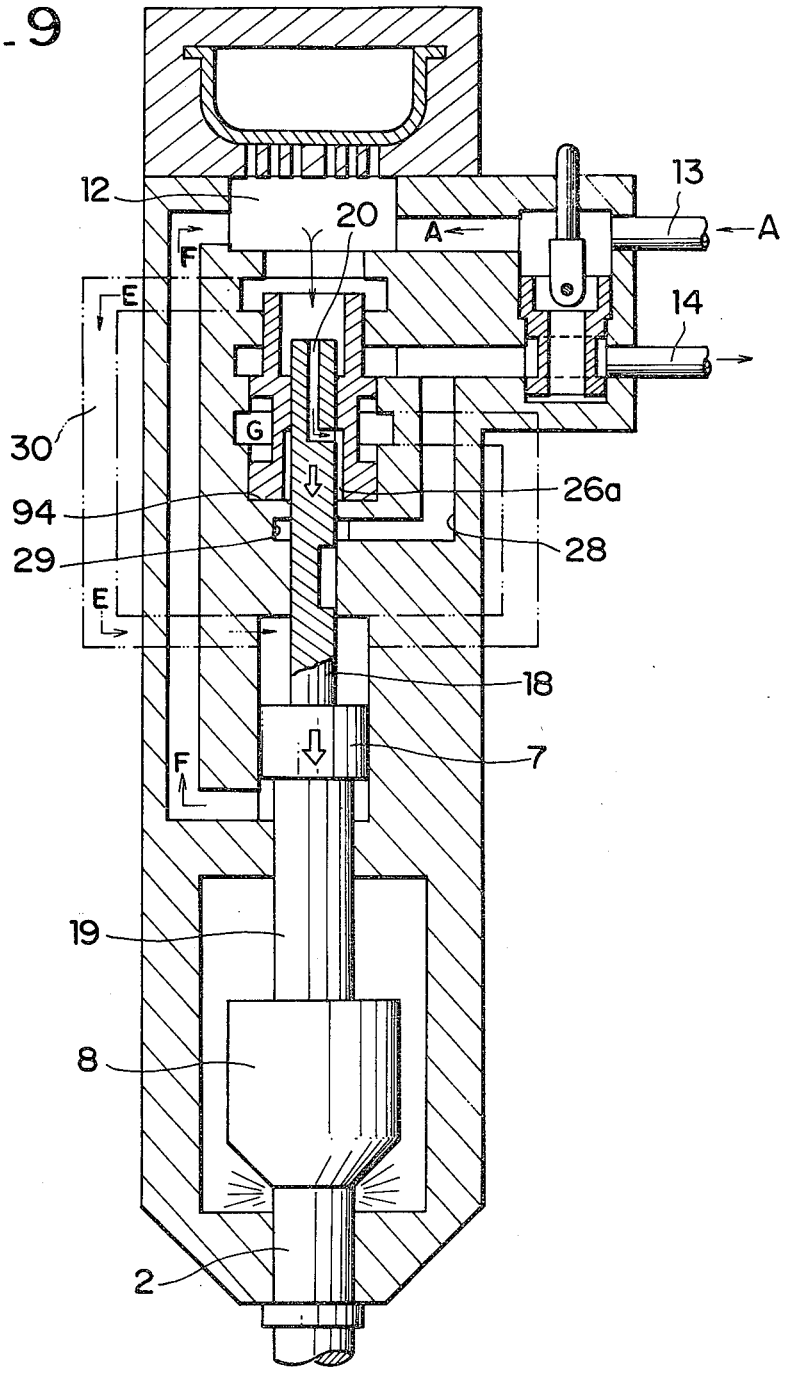
Figure 10:
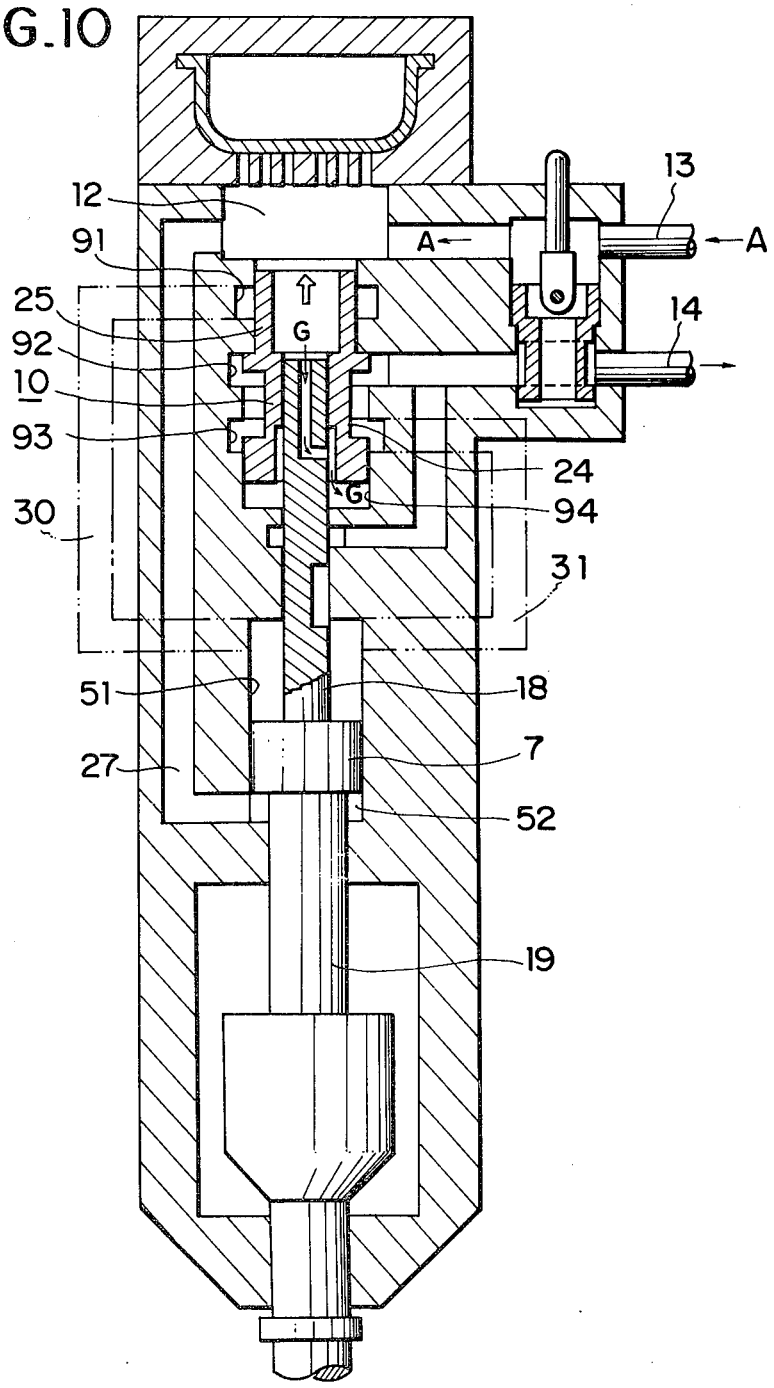

The piston 7 rapidly goes down and the hammer 8 at the lower piston 19 strikes the tool 2. This condition is shown in FIG. 9. On striking, the spool duct 20 of the upper piston 18 and the ring hole **26*a* of the switching valve 10 are connected, whereby the high pressure turns out a flood G and flows into the lower space 94 of the valve chamber 9. Since the lower space 94 and the concave 29 are then closed, the exhausting route 28** is blocked.

When the liquid flows into the lower space 94, the valve body 10 is pushed up by the force caused by the difference in the upper and lower areas, and returns to the condition shown in FIG. 6. The first concave 91 is closed by the tubular head 25 to close the way 30 from the upper chamber 12 to the upper piston chamber 51, and at the same time, the tubular concave 24 of the valve body 10 makes the communication between the second concave 92 and the third concave 93, so that the upper piston chamber 51 communicates with the outlet 14 via the way 31, and the piston 7 is moved up by the high pressure actuating liquid from the route 27 connected the upper chamber 12 and the lower piston chamber 52. By repeating the above mentioned actuations, the tool 2 is struck on and on.

Figure 11:
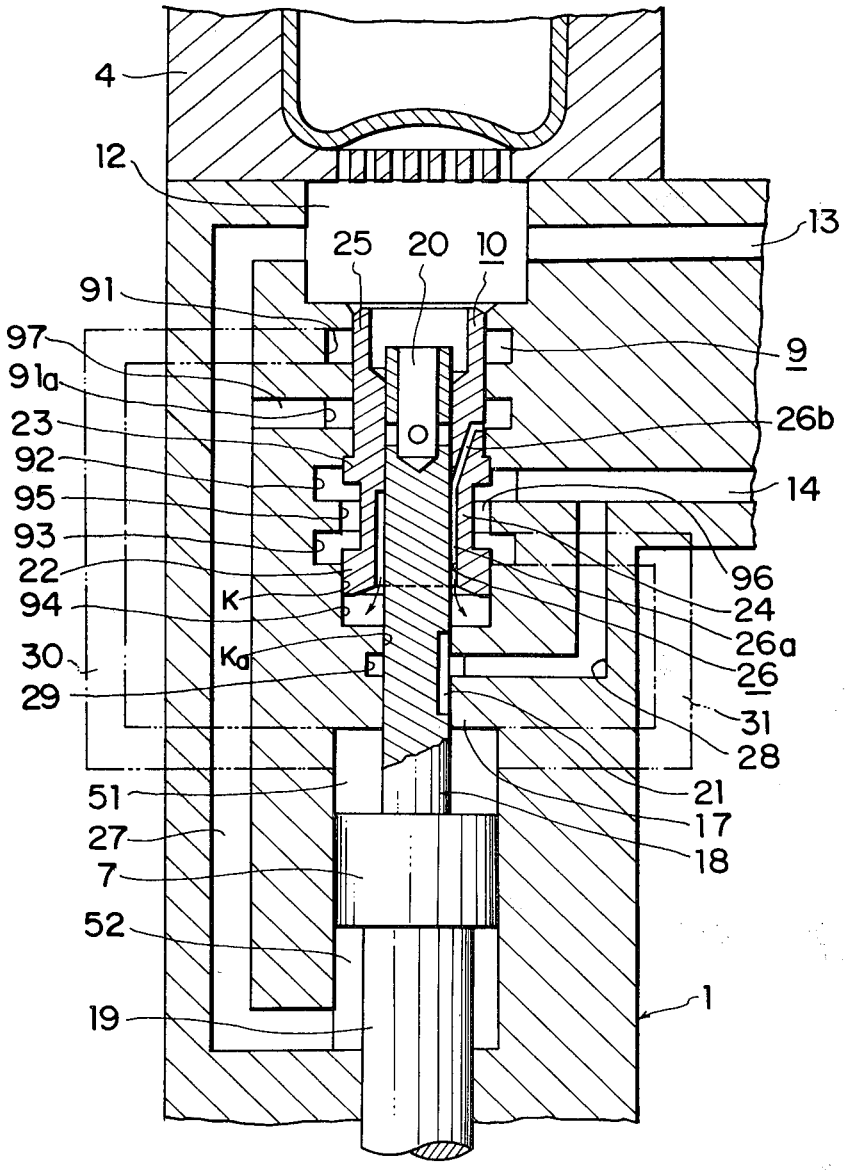
FIG. 11 is a cross sectional view showing another embodiment of a change-over valve mechanism where a valve body is positioned at an upper place.
Figure 12:
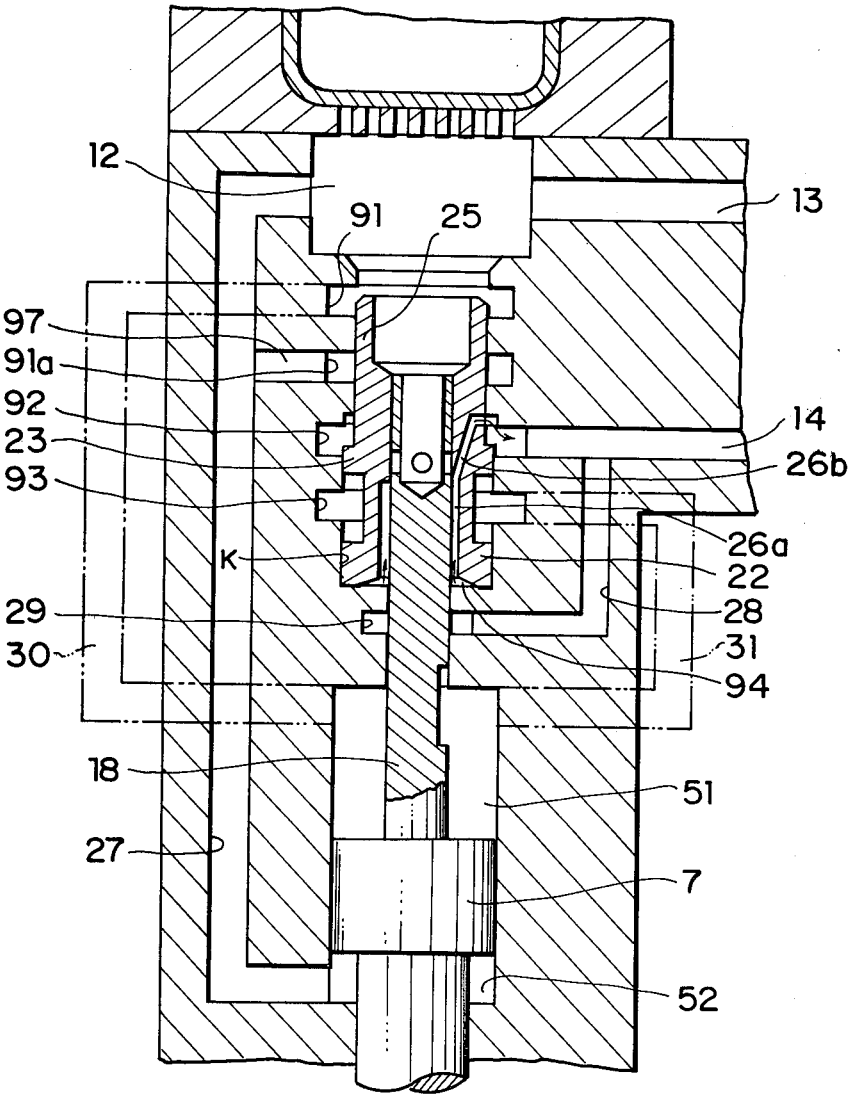
FIG. 12 is a cross sectional view showing the valve body positioning at a lower place.
Figure 13:
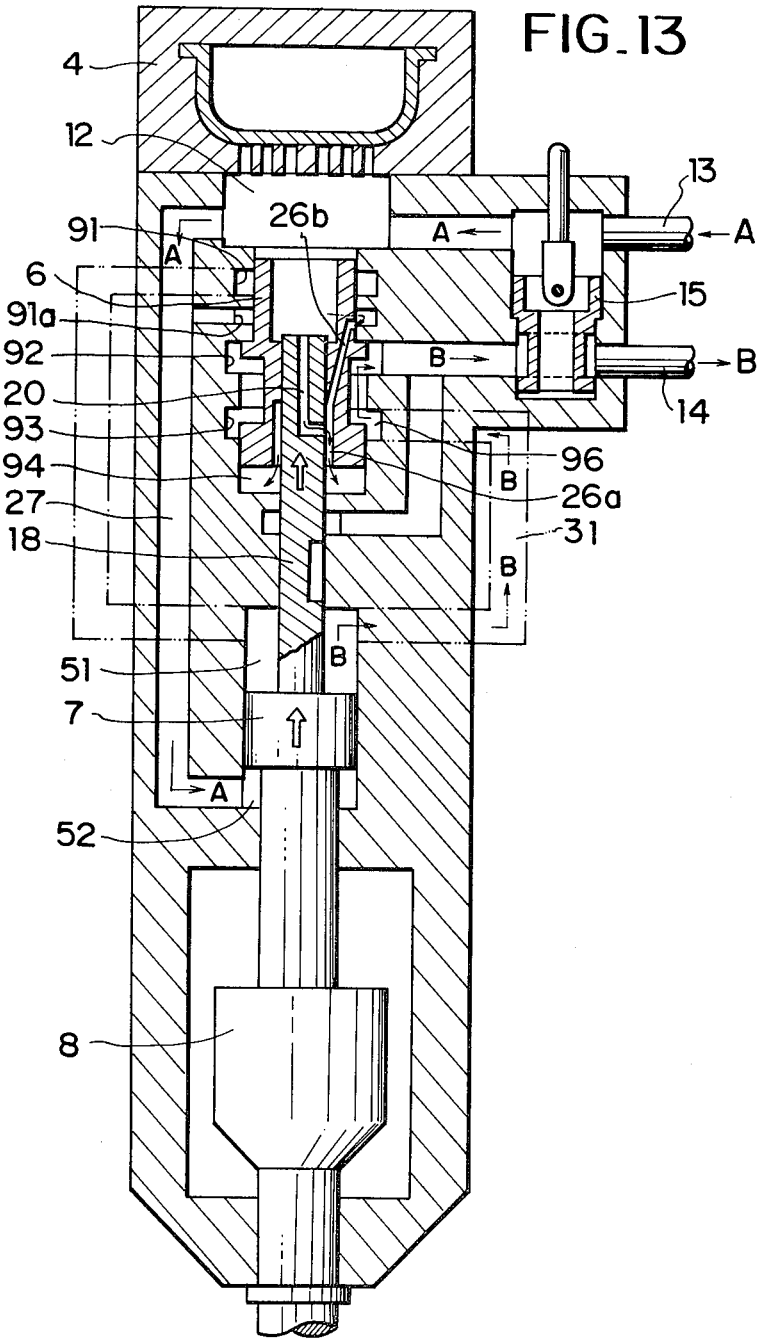
FIGS. 13 to 16 are cross sectional views stepwise showing actuations of the liquid pressure striking device provided with the change-over valve shown in FIGS. 11 and 12.
Figure 14:
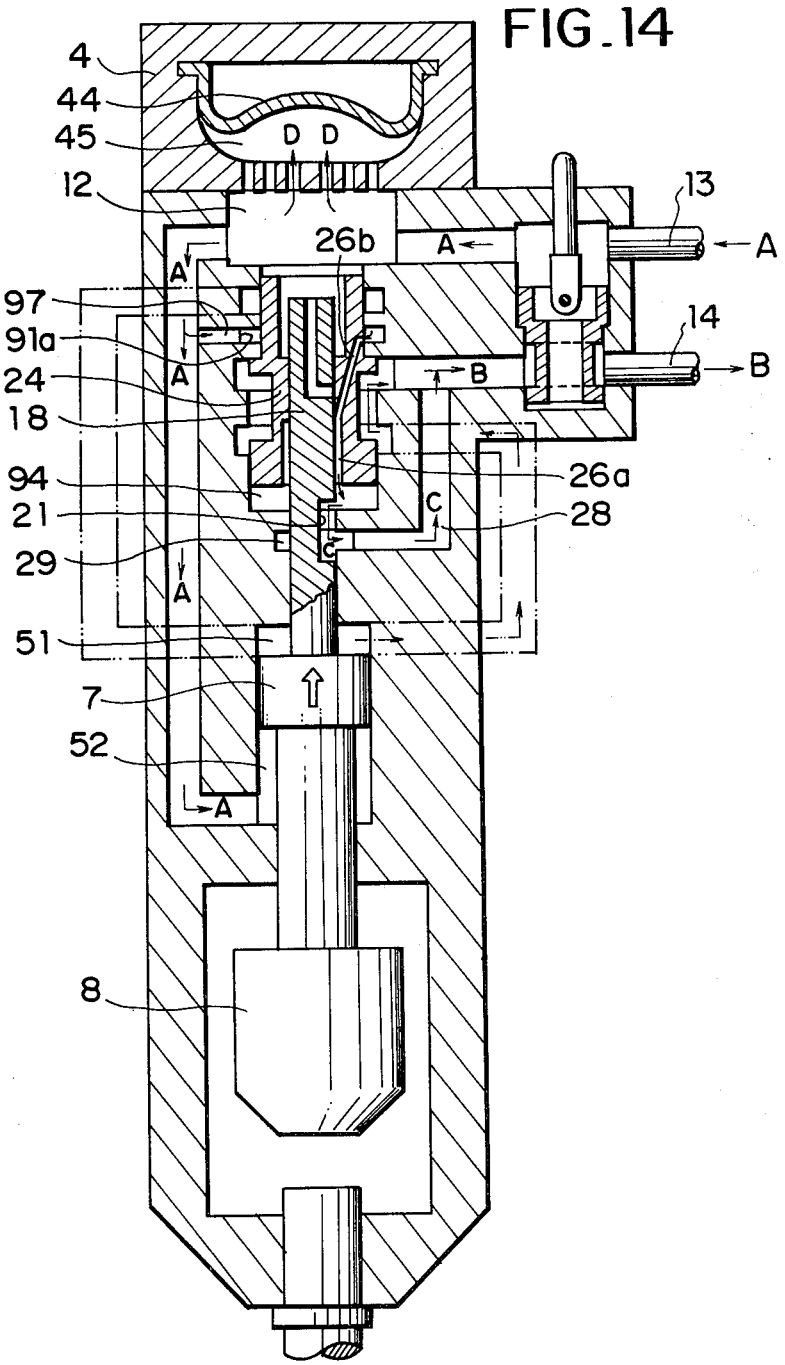
Figure 15:
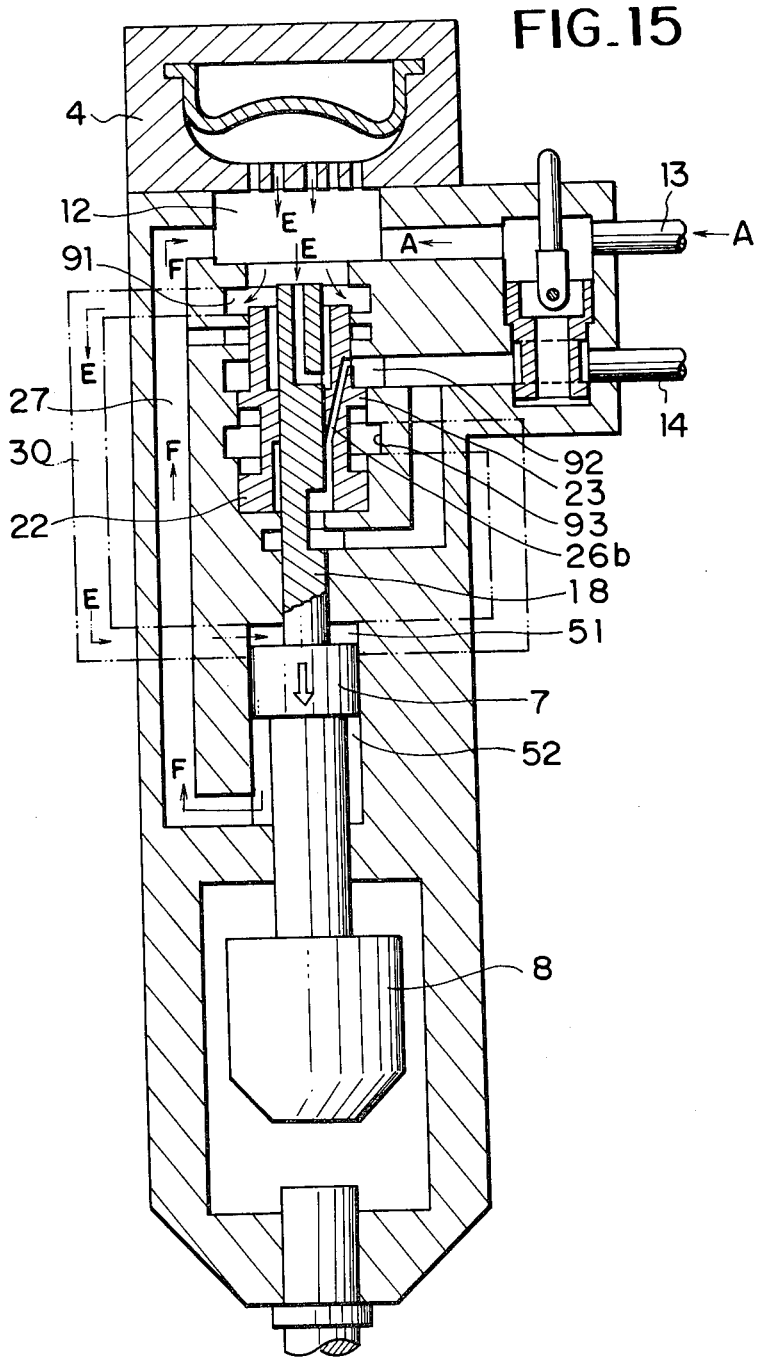
Figure 16:
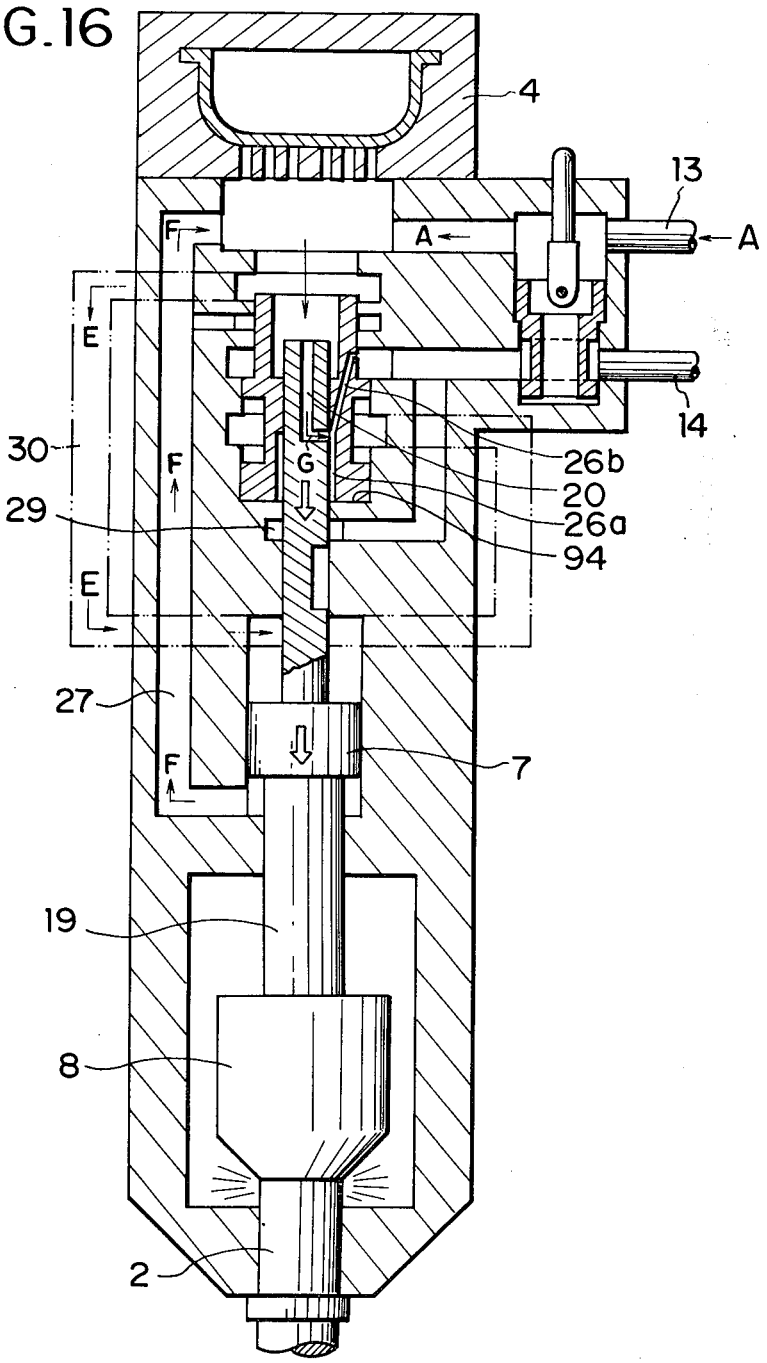

When the valve body 10 is positioned at the upper place, the liquid is supplied into the lower space 94 of the valve chamber 9 via the spool duct 20 of the upper piston 18 and the ring hole **26*a* of the valve body, and it is enclosed into the lower space 94 in accompany with ascending of the upper piston 18, so that the high pressure acts on the lower space 94 but the lower space is maintained at the lower pressure, since the upper second concave 92, the lower concave 93 and the lower concave 29 are connected to the outlet passage 14, respectively. As shown in FIG. 11, there are fine clearance K, Ka between the lower flange 22 of the valve body 10 and the lower space 94 and between the outer circumference of the control piston 18 and the concave 29. Therefore, the liquid in the lower space 94 leaks into the lower pressure side through the clearances K, Ka. Due to this leakage, the pressure of the lower space 94** becomes lower.

In the present invention, the valve body 10 is formed with a narrow duct **26*b*, and when the valve body 10 is positioned at the upper place (FIGS. 11, 13 and 14), a central concave 91*a* and the lower space 94 are communicated via the duct 26*b*. The concave 91*a* communicates with the passage 27 and is always kept at the high pressure owing to entrance of the high pressure liquid from the upper chamber 12. Therefore, the liquid always flows into the lower space 94 of the valve chamber 9 through the concave 91*a*—the narrow duct 26*b*—the ring hole 26*b*, thereby automatically compensate the pressure reduced by the leaking pressure from said clearance. Thus, the lower space 94 is kept at the determined pressure and the valve body 10** is very stably maintained.

When the valve body 10 is positioned at the lower place (FIGS. 12, 15 and 16), the lower space 94 is at the low pressure and the third concave 93 is at the high pressure since the communication with the outlet 14 is interrupted. The liquid invades into the lower space 94 via the clearance K from the third concave 93 to increase the pressure therein and moves up the valve body 10.

Under this condition, the narrow duct **26*b* has the communication of the lower space 94 and the second concave 92 which communicates with the outlet passage 14 and is always at the low pressure. Therefore, if the high pressure liquid invaded into the lower space 94 from the upper concave, it would be automatically exhausted from the route of the ring hole 26*a*—the narrow duct 26*b*—the second concave 92—the outlet 14, whereby the lower space 94 is kept at the determined low pressure, and also in this case, the valve body 10** may be maintained very stably.

At actuation of the main body 1, the valve upper chamber 321 of the actuating valve 15 and the lower chamber 322 are at the high pressure, and the valve central chamber 323 is at the low pressure by the amount of the backpressure. Then, the high pressure acts on the upper areas S1, S2 of the valve body, the lower area S3 and the lower area S5 of the actuating rod. Since the area S4 of the valve stopper is connected to the valve central chamber 323 by the duct D1, the low pressure of the backpressure only acts thereon. The actuating rod 35 is pushed by the large force owing to the high pressure acting on the area S5. Therefore, it is sufficient for continuously actuating the apparatus to push up the rod 35 and maintain it at the shown position against said force. When the pressure of the rod 35 is released it automatically returns to the condition shown in FIG. 2(A). Accordingly, a returning spring is not necessary and the structure is simplified as much.

In the invention, for reducing the force for pushing down the actuating rod 35, a stopper 331 is prepared on the outer circumference of the valve body 33. In the condition shown in FIG. 2(B), assuming the high pressure as $P_h$ and the backpressure as $P_1$, the force for pushing up the valve body 33 and the actuating rod 35 is "$P_h \times (S5+S3)+P_1 \times S4$", and the force for pushing them down is "$P_h \times (S1+S2)$". Therefore, if the relationship of the respective areas is determined as "$S5>(S1+S2)-S3=S4$", the force for pushing up the valve body 33 and the actuating rod 35 would be $P_1 \times (S5-S4)+P_h \times (S4)$. $P_1$ is far smaller than $P_h$ and can be neglected, and "$P_h \times (S5-S4)$" is the pushing-up force. Therefore, if the flowing pressure became larger, the force for manually pushing up the actuating rod 35 would be able to be regulated arbitrarily by appropriately setting "$(S5-S4)$".

The objects of this invention and the construction and advantages of a liquid pressure striking device of the invention will be apparent from the foregoing description. The invention is not limited to the specific embodiment described but of course includes various modifications within the scope of the appended claims.

What is claimed is:

1. A pressure liquid-striking device operating as a double-acting cylinder and comprising a main body (1); a tool mounted at a lowest portion of said body; an up-and-down reciprocating piston including a lower piston portion (19), an upper piston portion (18) and an intermediate portion (7) therebetween; a hammer (8) suspended on said lower piston portion coaxially with said tool so that the hammer imparts a striking motion to said tool upon reciprocation of said piston, said intermediate portion (7) being of a diameter (W) larger than diameters ($W_1$ and $W_2$) of said lower and upper piston portions, a change over mechanism (6) including a valve body (10) coaxially surrounding said upper piston portion (18) and having a ring-like head portion (25) and operative for automatically switching a pressure liquid flow by vertical movement of the piston, and a valve chamber (9) formed in said main body for accommodating said valve body (10) and controlling the movement of the valve body (10) together with the reciprocation of the piston; said main body being formed with an inlet passage (13) and an outlet passage (14) parallel to said inlet passage; an actuating valve (15) mounted in said main body for connecting said inlet passage to said outlet passage; said main body being further provided with an upper chamber (12) connected with an end of said inlet passage (13), a lower piston chamber (52), an upper piston chamber (51) and a through passage (27) connecting said upper chamber (12) with the lower piston chamber (52); an accumulator (4) mounted to said main body in communication with said upper chamber (12); a first connecting means (30) between said valve chamber (9) and said upper piston chamber (51); a second connecting means (31) between the outlet passage (14) and said upper piston chamber (51); said valve chamber (9) including a first concave (91), said ring-like head portion (25) normally interrupting communication between the upper chamber (12) and the first concave (91), said first connecting means (30) making communication between the upper chamber (12) and the upper piston chamber (51) only when said piston moves down, said valve chamber (9) further including a second concave (92) and a third concave (93) through which the liquid flows from the upper piston chamber (51) and said second connecting means (31) into the outlet passage (14) when the piston moves up, the second connecting means (31) being adapted to be blocked when the piston moves down; said main body being formed with a concave (29) below said valve chamber (9), said upper piston portion (18) being formed with a recess (21) between said valve chamber (9) and the upper piston chamber (51), said concave (29) communicating with the valve chamber (9) and the outlet passage (14) via said recess (21) only when the piston is switched upwardly to discharge pressure liquid to said outlet passage (14).

2. A device as claimed in claim 1, wherein the valve body (10) is provided with a lower flange (22) housed in a lower space of the valve chamber (9), an upper flange (23) spaced from the lower flange (22) at a determined distance and adapted to contact an upper wall forming the second concave (92) of the valve chamber (9) when the piston moves up, and a tubular portion including a groove on its outer surface and defined between the upper and lower flanges, which constitutes a relay (96) for communicating the upper piston chamber (51) and the outlet passage (14) when the piston moves up, said ring-like head portion (25) merging into the upper flange (23) and opening the first concave (91) communicating the upper chamber (12) and the upper piston chamber (51) only when the piston moves down.

3. A device as claimed in claim 1, wherein said valve chamber has a lower space (94), the valve body (10)

being always in communication at its one end with the lower space (94) of the valve chamber and having an inner duct (26), and the valve chamber (9) being formed with a central concave (91*a*) connected to the passage (27) connecting the upper chamber (12) with the lower piston chamber (52) between the first concave (91) and the second concave (92) for supplying the liquid under high pressure into the lower space (94) through the passage 27 and the central concave (91*a*) when the valve body (10) is in an upward position and for discharging the liquid under high pressure into the outlet passage (14) via the second concave (92) from the lower space (94) when the valve body 10 is in a downward position.

4. A device as claimed in claim 3, wherein the duct (26) includes a ring-like hole (26*a*) formed in the valve body 10 and an inclined passage (26*b*) extended in obliquity from said ring-like hole (26*a*) towards an outer surface of the valve body.

5. A device as claimed in claim 4, wherein the diameter (W) of the intermediate portion (7) of the piston, the diameter (W1) of the lower piston portion (19) and the diameter (W2) of the upper piston portion (18) are in relationship of $W<W1<W2$.

6. A device as claimed in claim 1, wherein the accumulator (4) is mounted on the top of the main body by means of a ring-like projection (41) formed on the accumulator and extended into the upper chamber (12) and secured to the main body (1) by means of bolts (48, 48) disposed at the outer circumference of the ring-like projection (41), the projection (41) being formed on its inner side with a plurality of perforations (42) communicating with the upper chamber (12), said accumulator including a liquid storage (45) with an expanding diaphragm (44) formed at the interior of the perforations (42).

7. A device as claimed in claim 1, wherein said main body is provided with a valve chamber (32) transversing the inlet passage (13) and the outlet passage (14) having a bottom and accommodating said actuating valve (15), said actuating valve (15) including a sleeve-like valve body (33) slidably housed within the valve chamber (32) and formed with an inner passage (34) and an outer concave (323), and an actuating rod (35) extended into an upper space of the valve body (33) with its lower end and projecting outwardly from the main body (1) at its upper portion, and wherein the passage (34) normally receives the liquid passing from the inlet passage (13) and communicates with the inlet passage (13) and the outlet passage (14) by maintaining the valve body (33) in an upward position, wherein if the actuating rod (35) is actuated by an external force the communication between the passage (34) and the outlet passage (14) is interrupted whereby the liquid in the main body (1) passes around the concave (323) outside of the valve body (33) and flows into the outlet passage (14), and the valve body (33) automatically returns to a normal condition by the liquid pressure acting on the bottom of the valve chamber (32) as the actuation of the actuating rod (35) is stopped.

* * * * *